US010118304B2

(12) United States Patent
Duff, Jr. et al.

(10) Patent No.: US 10,118,304 B2
(45) Date of Patent: Nov. 6, 2018

(54) METHOD OF TREATING RAZOR BLADE CUTTING EDGES

(71) Applicant: The Gillette Company, Boston, MA (US)

(72) Inventors: Ronald Richard Duff, Jr., Shrewsbury, MA (US); John Joseph Nisby, Hanson, MA (US); Kenneth James Skrobis, Maynard, MA (US); Joseph Allan Depuydt, Loveland, OH (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 14/788,878

(22) Filed: Jul. 1, 2015

(65) Prior Publication Data

US 2016/0001456 A1 Jan. 7, 2016

Related U.S. Application Data

(60) Provisional application No. 62/019,796, filed on Jul. 1, 2014.

(51) Int. Cl.
*B05D 3/02* (2006.01)
*B05D 1/02* (2006.01)
(Continued)

(52) U.S. Cl.
CPC ..... *B26B 21/60* (2013.01); *B05D 1/02* (2013.01); *B05D 3/0272* (2013.01); *B05D 3/105* (2013.01);
(Continued)

(58) Field of Classification Search
CPC ..... B05D 1/02; B05D 3/072; B05D 3/105; B05D 3/107; B05D 5/083; B05D 7/546
See application file for complete search history.

(56) References Cited

U.S. PATENT DOCUMENTS 3,071,856 A 1/1963 Fischbein
3,518,110 A 6/1970 Fischbein
(Continued)

*Primary Examiner* — Dah-Wei D. Yuan
*Assistant Examiner* — Kristen A Dagenais-Englehart
(74) *Attorney, Agent, or Firm* — Joanne N. Pappas; Kevin C. Johnson

(57) ABSTRACT

The present invention relates to razor blade cutting edges and methods of producing edges exhibiting improved shave performance longevity and lower cutting forces. Conventional razor blades have increasing cutting forces with use due to the outer coating wear and adhesion loss. Blade edges produced according to the novel process exhibit significantly lower cutting forces when subjected to wool felt cutting shaving simulation, which correlates to more comfortable shaves initially and over the life of the blades. The present invention treats razor blade edges having a first adherent polyfluorocarbon coating with a first solvent to partially remove the polyfluorocarbon coating, adds a second polyfluorocarbon coating, heats, and treats the blade edge with a second solvent providing a final blade edge having a thin, uniform polyfluorocarbon coating. Preferred solvents include perfluoroalkanes, perfluorocycloalkanes, and perfluoroaromatic compounds having a critical temperature or boiling point above the dissolution temperature for the polyfluorocarbon in the solvent.

21 Claims, 6 Drawing Sheets

(51) Int. Cl.

| | |
|---|---|
| ***B05D 3/10*** | (2006.01) |
| ***B26B 21/60*** | (2006.01) |
| ***B05D 5/08*** | (2006.01) |
| ***B05D 7/00*** | (2006.01) |

(52) U.S. Cl.
CPC ..... *B05D 3/107* (2013.01); *B05D 5/083* (2013.01); *B05D 7/546* (2013.01); *B05D 3/0254* (2013.01); *B05D 2350/63* (2013.01); *B05D 2350/65* (2013.01)

(56) References Cited

U.S. PATENT DOCUMENTS

| | | | | |
|---|---|---|---|---|
| 3,658,742 | A | 4/1972 | Fish et al. | |
| 4,012,551 | A | 3/1977 | Bogaty et al. | |
| 5,237,049 | A | 8/1993 | Cavanaugh et al. | |
| 5,263,256 | A | 11/1993 | Trankiem | |
| 5,985,459 | A * | 11/1999 | Kwiecien | B26B 21/60 30/346.5 |
| 6,110,532 | A * | 8/2000 | Causton | B26B 21/60 427/284 |
| 6,228,428 | B1 * | 5/2001 | Trankiem | B26B 21/60 427/284 |
| 7,247,249 | B2 | 7/2007 | Trankiem | |

* cited by examiner

| SUMMARY STATISTICS | |
|---|---|
| MEAN | 1.8521569 |
| STD DEV | 0.1333164 |
| STD ERR MEAN | 0.018668 |
| UPPER 95% MEAN | 1.8896527 |
| LOWER 95% MEAN | 1.814661 |
| N | 51 |

| SUMMARY STATISTICS | |
|---|---|
| MEAN | 1.6245098 |
| STD DEV | 0.0849073 |
| STD ERR MEAN | 0.0118894 |
| UPPER 95% MEAN | 1.6483904 |
| LOWER 95% MEAN | 1.6006292 |
| N | 51 |

METHOD OF TREATING RAZOR BLADE CUTTING EDGES

FIELD OF INVENTION

This invention relates to an improved polyfluorocarbon-coated razor blade cutting edge and its novel method of manufacture. Specifically, this invention relates to razor blade cutting edges which have a thin, well-adhered polyfluorocarbon coating and significantly improved first shave benefits which are maintained over subsequent shaves.

BACKGROUND OF INVENTION

Uncoated razor blades, despite their sharpness, cannot be employed for shaving a dry beard without excessive discomfort and pain, and it is as a practical matter necessary to employ with them a beard-softening agent such as water and/or a shaving cream or soap. Even with the beard-softening agent, the pain and irritation produced by shaving with uncoated blades are due to the excessive force required to draw the cutting edge of the blade through the beard hairs, the force of which is transmitted to the nerves in the skin adjacent the hair follicles from which the beard hairs extend, and, as is well known, the irritation produced by excessive pulling of these hairs may continue for a considerable period of time after the pulling has ceased. Blade coatings were developed to solve these shortcomings. However, conventional razor blades generally have increasing cutting forces with use due to the outer coating wear and adhesion loss.

Fischbein, U.S. Pat. No. 3,071,856, issued Jan. 8, 1963, describes fluorocarbon-coated blades, particularly polytetrafluoroethylene-coated blades. The blades may be coated by (1) placing the blade edge in close proximity to a supply of the fluorocarbon and subsequently heating the blade, (2) spraying the blade with a fluorocarbon dispersion, (3) dipping the blade into a fluorocarbon dispersion or (4) by use of electrophoresis. The resulting blade was later heated to sinter the polytetrafluoroethylene onto the blade edge.

Fischbein, U.S. Pat. No. 3,518,110, issued Jun. 30, 1970, discloses an improved solid fluorocarbon telomer for use in coating safety razor blades. The fluorocarbon polymer melts between 310° C. and 332° C. and at 350° C. has a melt flow from 0.005 to about 600 grams per ten minutes. The preferred polymers are believed to have molecular weights ranging from about 25,000 to about 500,000 grams/mole. For best results, the solid fluorocarbon polymer is broken down into particles ranging from 0.1 to 1 micron. The dispersion is electrostatically sprayed onto stainless steel blades.

Fish et al, U.S. Pat. No. 3,658,742, issued Apr. 25, 1972, discloses an aqueous polytetrafluoroethylene (PTFE) dispersion containing Triton X-100 brand wetting agent which is electrostatically sprayed on blade edges. The aqueous dispersion is prepared by exchanging the Freon solvent in Vydax brand PTFE dispersion (PTFE+Freon solvent), distributed by E.I. DuPont, Wilmington, Del., with isopropyl alcohol and then exchanging the isopropyl alcohol with water.

Trankiem, U.S. Pat. No. 5,263,256, issued Nov. 23, 1993 discloses an improved method of forming a polyfluorocarbon coating on a razor blade cutting edge comprising the steps of subjecting a fluorocarbon polymer having a molecular weight of at least about 1,000,000 grams/mole to ionizing radiation to reduce the average molecular weight to from about 700 to about 700,000 grams/mole; dispersing the irradiated fluorocarbon polymer in an aqueous solution; coating said razor blade cutting edge with the dispersion; and heating the coating obtained to melt, partially melt or sinter the fluorocarbon polymer.

Trankiem, U.S. Pat. No. 6,228,428 issued on May 8, 2001 discloses a method of forming a polyfluorocarbon coating on a razor blade cutting edge which comprises subjecting a fluorocarbon polymer having a molecular weight of at least 1,000,000 grams/mole in dry powder form to ionizing irradiation to reduce the molecular weight of the polymer, forming a dispersion of the irradiated polymer in a volatile organic liquid, spraying the dispersion on to a razor blade cutting edge and heating the coating obtained to sinter the polyfluorocarbon. The polyfluorocarbon preferably is polytetrafluoroethylene and irradiation preferably is effected to obtain a telomer having a molecular weight of about 25,000 grams/mole.

Kwiecien et al., U.S. Pat. No. 5,985,459, issued Nov. 16, 1999, describes a process for treating polyfluorocarbon coated razor blade cutting edges with a solvent which produces a blade edge which exhibits lower initial cutting forces which correlates with a more comfortable first shave over conventional razor blade cutting edges which exhibited high initial cutting forces.

Polytetrafluoroethylene coatings on razor blade cutting edges are clearly known in the art. Furthermore, it appears that various solvents systems have been proposed in the literature for polytetrafluoroethylene.

However, the art fails to appreciate the importance of a thin PTFE coating which is maintained during the initial or first shave but also for the majority of later shaves. Furthermore, the art is silent on selective removal of polytetrafluoroethylene from razor blade cutting edges, followed by additional coating with polytetrafluoroethylene.

It is an object of the present invention to provide a razor blade cutting edge with a thin, well adhered coating which provides significantly improved cutting force effects which are also sustained with use when compared with the prior art. This improvement in cutting force translates to an improved first shave and improved subsequent shaves.

It is also an object of the present invention to provide a razor blade which causes fewer nicks, improves comfort, and/or improves closeness.

Furthermore, it is an object of the present invention to provide a method producing these improved blades. The process utilizes novel processing steps.

These and other objects will become evident from the following disclosure.

SUMMARY OF THE INVENTION

The present invention provides a method of forming a polyfluorocarbon coating on a razor blade cutting edge including the steps of (a) coating a razor blade cutting edge with a first dispersion of polyfluorocarbon in a dispersing medium; (b) heating the coating to adhere the polyfluorocarbon to the blade edge; (c) treating the razor blade cutting edge with a first solvent to partially remove the first coating; (d) coating the blade edge with a second dispersion of polyfluorocarbon in a dispersing medium; and (e) heating the coating of step (d) to adhere the second polyfluorocarbon to the blade edge.

The present invention provides a method of forming a polyfluorocarbon coating on a razor blade cutting edge further including the step of (f) treating the blade edge of step (e) with a second solvent to partially remove the second coating of step (d).

The present invention provides a method of forming a polyfluorocarbon coating on a razor blade cutting edge wherein the critical temperature or boiling point of the first and second solvents is above the dissolution temperature for the first and second polyfluorocarbons in the first and second solvents, respectively, and wherein the blade treatment step (c) or step (f) occurs at a process temperature below the boiling point or critical temperature of the first and second solvents, respectively, and above the dissolution temperature for the first and second polyfluorocarbons, respectively, in the first and second solvents.

The first and the second solvent are selected from the group consisting of perfluoroalkanes, perfluorocycloalkanes, perfluoroaromatic compounds and oligomers thereof.

The polyfluorocarbon is polytetrafluoroethylene having an average molecular weight of from about 700 to about 4,000,000 grams/mole. The polytetrafluoroethylene preferably has an average molecular weight of from about 22,000 to about 200,000 grams/mole.

The present invention provides that the polyfluorocarbon of step (a) is polytetrafluoroethylene having an average molecular weight and molecular weight distribution, and the polyfluorocarbon of step (d) is polytetrafluoroethylene having a different average molecular weight and/or molecular weight distribution than the polyfluorocarbon of step (a).

The present invention provides the polytetrafluoroethylene of step (a) having an average molecular weight of from greater than about 200,000 to about 4,000,000 grams/mole and the polytetrafluoroethylene of step (d) having an average molecular weight of from about 3,000 to about 200,000 grams/mole.

The present invention provides the polytetrafluoroethylene of step (a) having an average molecular weight of from about 3,000 to about 200,000 grams/mole and the polytetrafluoroethylene of step (d) having an average molecular weight of from greater than about 200,000 to about 4,000,000 grams/mole.

The present invention provides the polyfluorocarbon of step (a) is polytetrafluoroethylene having an average molecular weight and molecular weight distribution, and the polyfluorocarbon of step (d) is polytetrafluoroethylene having substantially the same average molecular weight and molecular weight distribution as the polyfluorocarbon of step (a).

The present invention provides the polyfluorocarbon of step (a) is polytetrafluoroethylene having an average molecular weight of from greater than about 200,000 to about 4,000,000 grams/mole and the polyfluorocarbon of step (d) is polytetrafluoroethylene having an average molecular weight of from greater than about 200,000 to about 4,000,000 grams/mole.

The present invention provides the polyfluorocarbon of step (a) is polytetrafluoroethylene having an average molecular weight of from about 3,000 to about 200,000 grams/mole and the polyfluorocarbon of step (d) is polytetrafluoroethylene having an average molecular weight of from about 3,000 to about 200,000 grams/mole.

The present invention provides that the first solvent of step (c) and the second solvent of step (f) differ in composition, temperature, and/or method of application.

The present invention provides the first and/or second solvent is selected from the group consisting of: dodecafluorocyclohexane ($C_6F_{12}$), octafluoronaphthalene ($C_{10}F_8$), perfluorotetracosane (n-$C_{24}F_{50}$), perfluoroperhydrophenanthrene ($C_{14}F_{24}$), isomers of perfluoroperhydrobenzylnaphthalene ($C_{17}F_{30}$), high-boiling oligomeric byproducts in the manufacture of perfluoroperhydrophenanthrene ($C_{14}F_{24}$), perfluoropolyethers, or any combinations thereof.

The present invention provides the first and/or second solvent includes perfluoroperhydrophenanthrene.

The present invention may further include a post treatment step (g) to remove excess solvent.

The present invention provides that the cutting force obtained after step (f) is reduced by about 5 to about 15 percent over the cutting force obtained after step (c).

The present invention provides that the cutting force obtained after step (e) is reduced by about 5 to about 15 percent over the cutting force obtained after step (c) over the life of the blade.

The present invention provides that, after the heating step (b) and/or step (e), a thickness of the polyfluorocarbon coating is greater than 1.0 micrometers.

The present invention provides a razor blade cutting edge produced according to the method outlined above.

DETAILED DESCRIPTION OF THE PRESENT INVENTION

Figure 1:
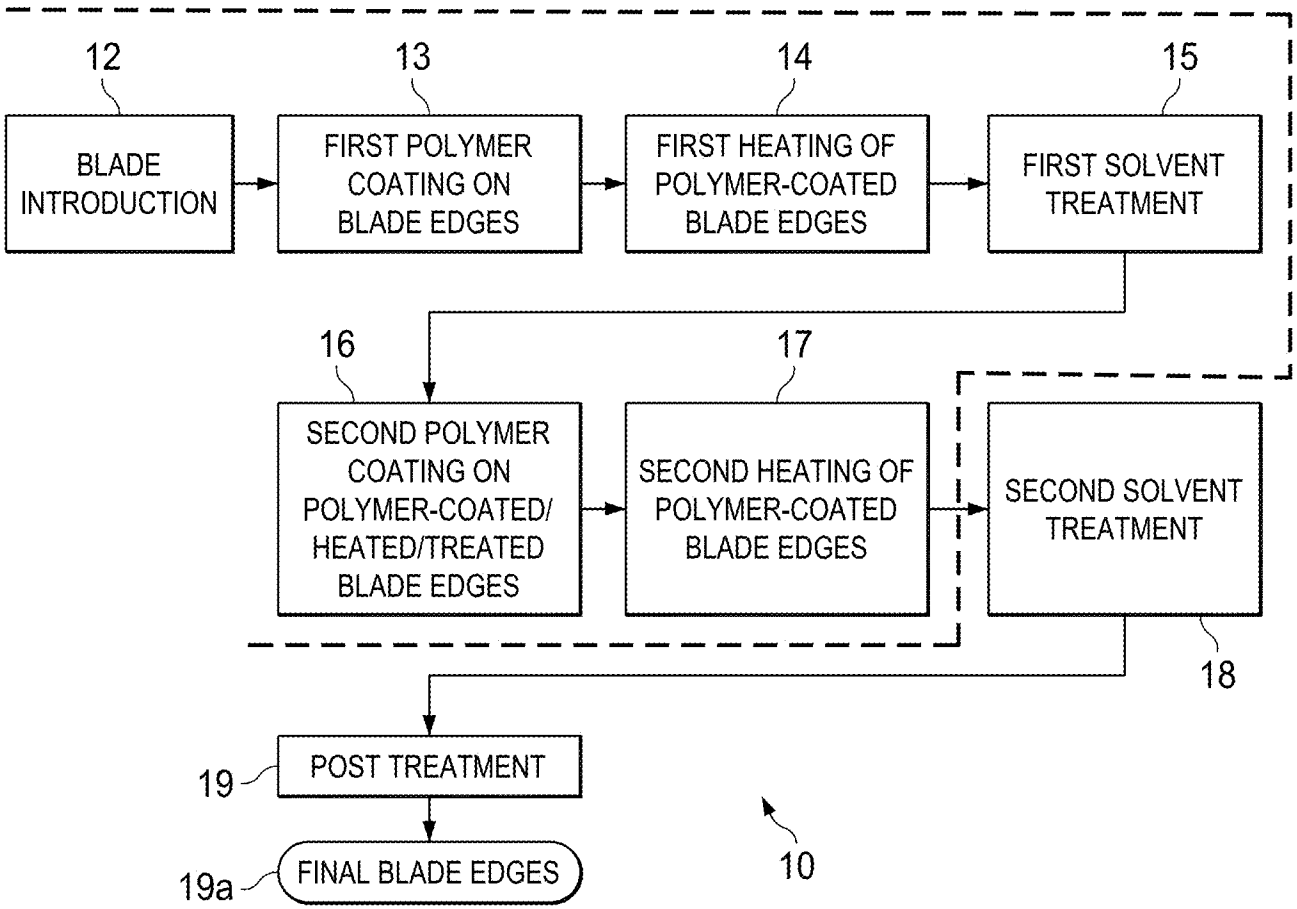
FIG. 1 is a schematic flow diagram of the present invention for treating razor blade cutting edges.

This invention concerns a novel process for treating polyfluorocarbon-coated razor blade cutting edges, particularly polytetrafluoroethylene-coated razor blade cutting edges. The razor blade cutting edges produced by the novel process may be disposed in a razor cartridge providing a razor with improved shaving attributes for a user.

The present invention relates to razor blade cutting edges which exhibit an improvement in the first cut (e.g., lower cut force) and in subsequent cuts which correlates to improved shaves for the life of the blade and the method of producing these razor blade cutting edges. Prior art razor blade cutting edges exhibit initial cut (or first shave) improvements. However, razor blades produced according to the present process exhibit significantly lower initial cutting forces which are sustained and which correlate to improved shave performance from the beginning and for the life of the blade. Improved blades according to the present invention involve treating conventional razor blade cutting edges having an adherent polyfluorocarbon coating with a solvent to partially remove the coating, then coating with polyfluorocarbon, sintering and further treatment with a solvent. Preferred solvents include perfluoroalkanes, perfluorocycloalkanes, perfluoroaromatic compounds and oligomers thereof having a critical temperature or boiling point above the dissolution temperature for the polyfluorocarbon in the solvent.

All percentages and ratios described herein are on a weight basis unless other indicated.

As used herein the term "razor blade cutting edge" includes the cutting point or ultimate blade tip and the facets of the blade. The entire blade edge could be coated in the manner described herein; however; an enveloping coat of the type herein is not believed to be essential to the present invention. Razor blades according to the present invention include all types known in the art. For example, stainless steel blades are commonly used. Many other commercial razor blades also include chromium or a chromium/platinum interlayer between the steel blade and the polymer. Other interlayers may also be feasible and are known in the art. A chromium interlayer is typically sputtered onto the blade edge surface prior to polymer coating. Furthermore, a similar process may be used to coat the blade with other materials, for instance, but not limited to, a Diamond Like Carbon (DLC) material coating as described in U.S. Pat. Nos. 5,142,785 and 5,232,568, incorporated herein by reference, prior to an outer polymer coating.

Various methods have been proposed for coating razor blade cutting edges with polyfluorocarbons.

Surprisingly, it was discovered that, when a blade which is coated with a polyfluorocarbon dispersion is subsequently heated and treated with a suitable solvent, and effectively "thinned", and is then re-coated and re-heated, the resultant blade edge has an improved cutting surface providing better shave characteristics over the prior art over the life of the blade. Thus, applying one or more second coatings on an already thinned coating and then heating that coating provides unexpected blade benefits over the prior art, such as comfort and reduced cutting force with use over the life of the blade. This may be counterintuitive since, as generally known, adding a coating or making a thicker coating on a blade edge may result in undesirable higher cutting forces.

Further surprising still, when this second heated coating was subsequently treated one or more times with a second suitable solvent, the resulting blade edge comprises a surface with even additional enhanced shave characteristics over the prior art such as improved first shave cutting force and maintained lower cutting forces for the majority of subsequent shaves over the life of the blade. The lower cutting forces exhibited are unexpected to those of skill in the art, particularly since the resulting blade edge's outer polymer layer appears to be similar to that of a prior art blade.

Figure 1A:
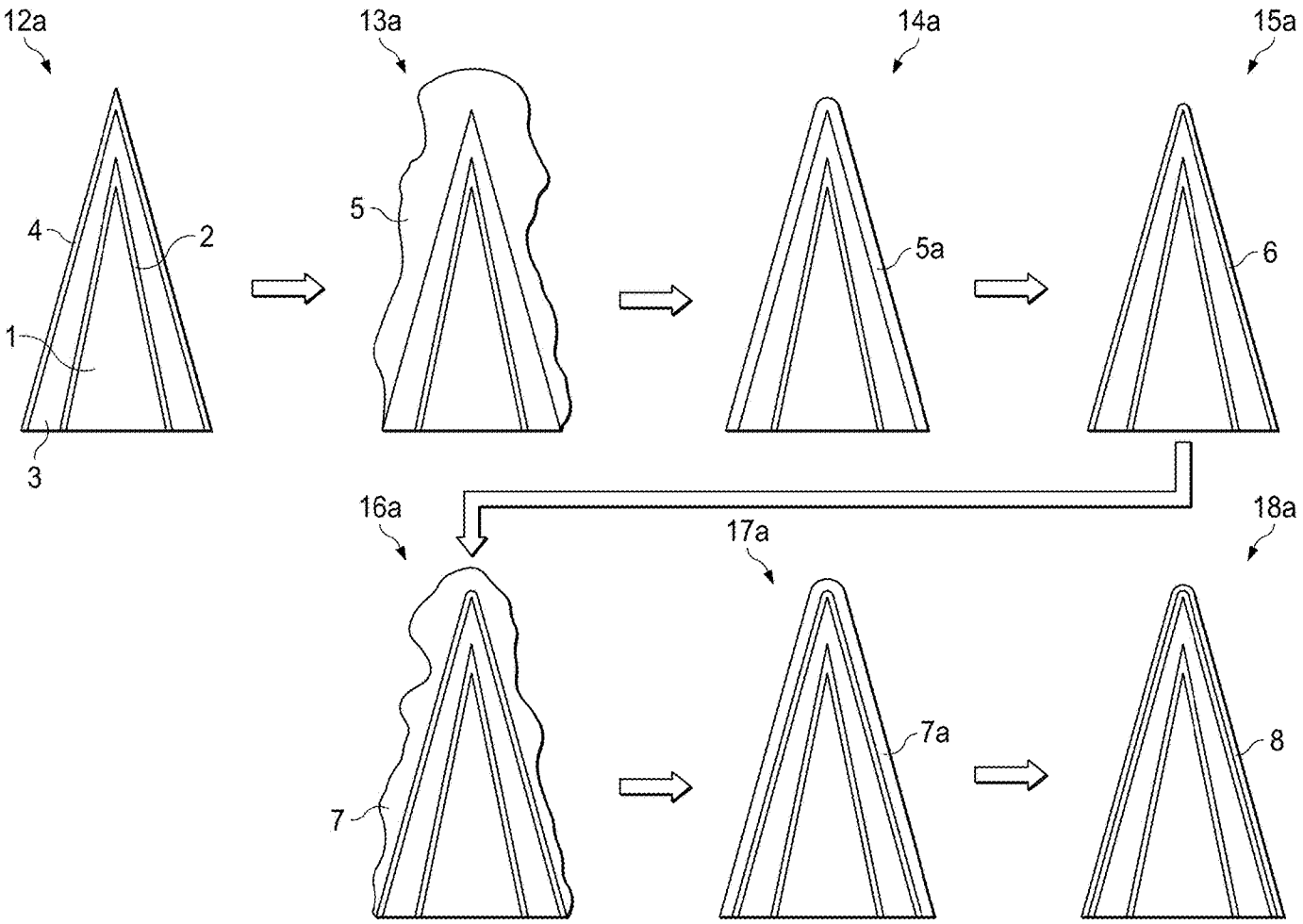
FIG. 1A is a graphical depiction of the blade cutting edges after each step of the flow diagram of FIG. 1 is performed.

Desirably, the process steps of the present invention are performed as shown in FIG. 1 in conjunction with FIG. 1A. FIG. 1A depicts of a cross-sectional view of an example of a blade edge 12*a* as it flows through the process of FIG. 1.

The present invention process 10 is shown in FIG. 1 and starts with the introduction of a blade at step 12 of FIG. 1 into the blade polymer coating process. The blade has a blade edge 12*a* (FIG. 1A). Blade edge 12*a* may have one or more prior coatings already deposited thereon. For instance, in one non-limiting embodiment of the present invention, the blade 12*a*, as it is introduced, as shown in FIG. 1A, has a substrate 1, such as stainless steel, an interlayer 2, such as niobium, a hard coating layer 3, such as a diamond or diamond like coating, and an overcoat layer 4, such as chromium. Other types and numbers of layers are also contemplated in the present invention. At the end of the process of FIGS. 1 and 1A, a final blade edge 18*a* at step 18 (or step 19*a*) will be formed having an thin uniform layer 8 as shown in FIG. 1A.

A first polyfluorocarbon or polymer coating in FIG. 1A is applied to the blade edge at step 13 of FIG. 1 resulting in a first polyfluorocarbon-coated blade edge, as shown by coating 5 on blade 13*a* in FIG. 1A. As shown, coating 5 is not uniform. Next, the blade is heated at step 14 to produce blade 14*a* having heated coating 5*a* (FIG. 1A) and subsequently solvent-treated at step 15 of FIG. 1 to remove some of the polyfluorocarbon, but leaving a thin uniform polyfluorocarbon coating, as shown by blade 15*a* having treated coating 6 in FIG. 1A.

The uniformity of the coating or a "uniform" coating as used herein signifies that the coating provides substantially full coverage with a generally consistent depth and/or even profile throughout.

The blade 15*a* is then recoated at step 16 of FIG. 1 with a second polyfluorocarbon material 7 forming blade edge 16*a* (FIG. 1A) This coating, which is not uniform as deposited, is re-heated with a second heating at step 17 of FIG. 1 producing heated coating 7*a* on blade edge 17*a* (FIG. 1A), and subsequently, optionally but desirably, may be solvent-treated at step 18 to partially remove the polyfluorocarbon leaving a uniform thin coating 8 on blade edge 18*a*.

The present invention contemplates that steps 16, 17, and 18 of FIG. 1 may be performed one or more times to achieve desired blade performance. Optionally, the solvent-treated blade is finally subjected to a post-treatment step (shown at step 19 of FIG. 1) to remove any excess solvent.

The process of the present invention results in a polyfluorocarbon coating drat generally may approach the molecular level of thickness.

The present invention process may omit either both steps 18 and 19 or just step 19 before proceeding to a final blade at step 19*a* while still maintaining the longevous shaving characteristic benefits.

Each of these steps or phases of the present invention process is further described below:

Preparing a Polyfluorocarbon-Coated Blade Edge

Polyfluorocarbon-coated blade edges according to the present invention can be prepared by any process known in the art. Preferably, the blade edge is coated with a polyfluorocarbon dispersion. The dispersion-coated blade edge is next heated to drive off the dispersing media and to heat the polyfluorocarbon onto the blade edge. These processing steps are further described as follows:

A. Polyfluorocarbon Dispersion

According to the present invention, a dispersion is prepared from a fluorocarbon polymer. The preferred fluorocarbon polymers (i.e. starting materials) are those which contain a chain of carbon atoms including a preponderance of $—CF_2—CF_2—$ groups, such as polymers of tetrafluoroethylene, including copolymers such as those with a minor proportion, e.g. up to 5% by weight of hexafluoropropylene. These polymers have terminal groups at the ends of the carbon chains which may vary in nature, depending, as is well known, upon the method of making the polymer. Among the common terminal groups of such polymers are, —H, —COOH, —Cl, $—CCl_3$, $—CFClCF_2Cl$, $—CH_2OH$, $—CH_3$ and the like. The preferred polymers of the present invention have average molecular weights ranging from about 700 to about 4,000,000 grains/mole, and preferably from about 22,000 to about 200,000 grams/mole.

An "average molecular weight" as used herein generally refers to the number average molecular weight of the polyfluorocarbon used to produce the coating. It is equal to the total weight of all the polymer molecules in a representative sample, divided by the total number of polymer molecules in the representative sample. The term "molecular weight distribution" as used herein refers to the distribution of molecular weights that produces the number average molecular weight of a representative sample. As one of skill in the art may recognize, an average molecular weight may be the same between two materials but their respective molecular weight distributions may be quite different.

The most preferred fluorocarbon polymer (i.e., starting material) is polytetrafluoroethylene (PTFE).

The present invention contemplates that the polyfluorocarbon of the coating step 13 of FIG. 1 is polytetrafluoroethylene (PTFE) having an average molecular weight and/or molecular weight distribution which is the same, substantially the same, or within the same general range as that of the polyfluorocarbon of coating step 16 of FIG. 1.

For instance, the polytetrafluoroethylene of coating step 13 of FIG. 1 may have an average molecular weight of from greater than about 200,000 to about 4,000,000 grams/mole and the polytetrafluoroethylene of coating step 16 of FIG. 1 may also have an average molecular weight that is the same or substantially the same as that of coating step 13 or within the same range, e.g., of from greater than about 200,000 to about 4,000,000 grams/mole. Alternatively, the polytetrafluoroethylene of coating step 13 of FIG. 1 may have an average molecular weight of from about 3,000 to about 200,000 grams/mole and the polytetrafluoroethylene of coating step 16 of FIG. 1 may also have an average molecular weight that is the same or substantially the same as that of coating step 13 or within the same range, e.g., of from about 3,000 to about 200,000 grams/mole.

Further, the polyfluorocarbon of coating step 13 of FIG. 1 may be a polytetrafluoroethylene having an average molecular weight and/or molecular weight distribution which is different than that of the polyfluorocarbon of coating step 16 of FIG. 1.

For instance, the polytetrafluoroethylene of coating step 13 of FIG. 1 may have an average molecular weight of from greater than about 200,000 to about 4,000,000 grams/mole and the polytetrafluoroethylene of coating step 16 of FIG. 1 may have an average molecular weight of from about 3,000 to about 200,000 grams/mole. Or alternatively, the polytetrafluoroethylene of coating step 13 of FIG. 1 may have an average molecular weight of from about 3,000 to about 200,000 grams/mole and the polytetrafluoroethylene of coating step 16 of FIG. 1 may have an average molecular weight of from greater than about 200,000 to about 4,000,000 grams/mole.

Generally, the benefit of having a first coating or layer of PTFE having a first average molecular weight and a separate second coating or layer of PTFE subsequently deposited on the first coating or layer having a similar or different second average molecular weight on blade edges is the resultant enhanced coverage, uniformity, and/or adhesion resulting in lower overall friction and/or cutting forces which generally provides more improved shaving characteristics over a longer period of time.

Additionally, the present invention contemplates that the resultant polyfluorocarbon coating after steps 14 and/or 17 includes polytetrafluoroethylene with a resultant thickness of less than about 0.5 micrometers.

In an alternate preferred embodiment, the present invention contemplates that the resultant polyfluorocarbon coating after steps 14 and/or 17 includes polytetrafluoroethylene with a resultant thickness greater than about 0.5 micrometers, more preferably near or greater than about 1.0 micrometer. In particular, blade edges of the heated second polyfluorocarbon coating being significantly thicker than prior art polyfluorocarbon coated blade edges (e.g., U.S. Pat. No. 5,985,459), have specific applications where skin comfort and/or cutting force reduction with use may be desired.

A thicker second PTFE coating over a well-adhered and solvent-treated first PTFE coating of the present invention is advantageous in that the resultant blade edge may also provide skin comfort by reducing the blade to skin interaction while also maintaining the blade edge to hair engagement and cutting ability.

As discussed below, the second coating of the present invention may be solvent-treated at step 18 as shown in FIG. 1 further enhancing the shave characteristics such as reducing the cutting force. Additionally, the present invention contemplates that the resultant polyfluorocarbon coating after steps 15 and/or 18 includes polytetrafluoroethylene with a resultant thickness of less than or equal to about 0.2 micrometers.

The preferred commercial polyfluorocarbons include materials manufactured by DuPont™ such as DuPont™ Zonyl® fluoroadditive powders and/or dispersions (e.g., MP1100, MP1200, MP600, and MPD1700) or DuPont™ DryFilm® dispersions, such as LW-2120 or the RA series.

Polyfluorocarbon dispersions according to the present invention comprise from 0.05 to 10% (wt) polyfluorocarbon, preferably from 0.5 to 2% (wt), dispersed in a dispersant media. The polymer dispersion can be introduced into the flow stream directly or a polymer powder can be mixed into a dispersing medium and then homogenized prior to being introduced into the flow stream.

For the purpose of forming the dispersion to be sprayed onto the cutting edges, the polyfluorocarbon should have a very small submicron particle size.

Dispersing medium is typically selected from the group consisting of fluorocarbons (e.g., Freon brand from DuPont), water, volatile organic compounds (e.g., isopropyl alcohol), and supercritical $CO_2$. Water is most preferred.

When an aqueous dispersing medium is used, a wetting agent is often necessary, especially when the particle size is large. Generally these wetting agents may be selected from the various surface active materials which are available for use in aqueous, polymeric dispersions. The preferred wetting agents for use in the present invention include alkylphenylpolyalkyleneether alcohols such as Triton X100®, sold by Dow Corporation, though many other viable agents are known in the art. Generally, the amount of wetting/dispersing agent employed may be varied. The wetting/dispersing agent is generally used in amounts ranging from about 2% to 20% by weight of the fluorocarbon polymer, preferably at least about 10% by weight of the fluorocarbon polymer.

B. Applying the Dispersion

The dispersion may be applied to the cutting edge in any suitable manner to give as uniform a coating as possible, as for example, by dipping or spraying; nebulization is especially preferred for coating the cutting edges, in which case an electrostatic field may be employed in conjunction with the nebulizer in order to increase the efficiency of deposition. For further discussion of this electrostatic spraying technique, see U.S. Pat. No. 3,713,573 of Fish, issued Jan. 30, 1973, incorporated herein by reference. Preheating of the dispersion may be desirable to facilitate spraying, the extent of preheating depending on the nature of the dispersion. Preheating of the blades to a temperature approaching the boiling point, or higher than the boiling point of the dispersant media, may also be desirable.

C. Heat the Polyfluorocarbon onto the Blades

In any event the blades carrying the deposited polymer particles on their cutting edges must be heated at an elevated temperature to form an adherent coating on the cutting edge and to drive off the dispersant media. The period of time during which the heating is continued may vary widely, from as little as several seconds to as long as several hours, depending upon the identity of the particular polymer used, the nature of the cutting edge, the rapidity with which the blade is brought up to the desired temperature, the temperature achieved, and the nature of the atmosphere in which the blade is heated. It is preferred that the blades are heated in an atmosphere of inert gas such as helium, argon, nitrogen, etc., or in an atmosphere of reducing gas such as hydrogen, or in mixtures of such gases, or in vacuum. The heating must be sufficient to permit the individual particles of polymer to, at least, sinter.

Preferably, the heating shall be sufficient to permit the polymer to spread into a substantially continuous film of the proper thickness and to cause it to become firmly adherent to the blade edge material.

Thus, the heating of the coating is intended to cause the polymer to adhere to the blade. The heating operation can result in a sintered, partially melted or melted coating. A partially melted or totally melted coating is preferred as it allows the coating to spread and cover the blade more thoroughly. For more detailed discussions of melt, partial melt and sinter, see McGraw-Hill Encyclopedia of Science and Technology, Vol. 12, 5th edition, pg. 437 (1992), incorporated herein by reference.

The heating conditions, i.e., maximum temperature, length of time, etc., obviously must be adjusted so as to avoid substantial decomposition of the polymer and/or excessive tempering of the metal of the cutting edge. Preferably, a target processing temperature for MP1100 brand polytetrafluoroethylene, manufactured by DuPont, is about 650° F., and generally should not exceed 750° F.

As described herein, the present invention process calls for two heating steps in FIG. 1 at step 14 and then at step 17. The second heating step 17 of FIG. 1 may desirably occur after the occurrence of the following: a first polyfluorocarbon coating at step 13, a first heating step at step 14, a first solvent-treating step at step 15 and a second polyfluorocarbon coating step at step 16.

The second heating step 17 of the present invention assists in sufficiently adhering the first and/or the second polyfluorocarbon (e.g., a polymer such as PTFE telomer) coating to the blade edge surface and in particular, if present, to any "active sites" on the blade edge surface. Active sites generally refer herein to the areas on the blade edge surface where a polyfluorocarbon could still bond. These areas may generally exist on the blade edge surface because they were not properly coated or covered after carrying out the first coating step 13 or because they resulted or were exposed after the first heating step 14 and/or solvent treatment step 15 of the present invention.

The present invention as noted above, contemplates that the process of treating the blade cutting edge may be finalized after completing the second heating step at step 17 of FIG. 1 (blade 17*a* of FIG. 1A). Preferably however, a second solvent treatment step 18 of FIG. 1 may also be desirably performed to produce a final blade cutting edge such as shown by the blade edge 18*a* of FIG. 1A.

Solvent Treatment

A primary feature of the present invention involves treating polyfluorocarbon-coated blades, like those described above, with a solvent to essentially "thin" the polyfluorocarbon coating. The solvent treatment partially removes the polyfluorocarbon coating that was initially deposited and heated on the blade edge surface. The portion of the polyfluorocarbon coating that is removed may generally be referred to as being "non-adherent" soluble polymer molecules of the coating.

A second solvent treatment (e.g., step 18 of FIG. 1) may be desirably performed after second coating step 16 and second heating step 17 of FIG. 1 have been executed. The resulting blade possesses a substantially uniform thin coating along the cutting edge surface.

It should be noted that the present invention contemplates that the first solvent treatment step and the second solvent treatment step may utilize solvents which are the same or alternately, which differ in composition, temperature, and/or method of application in order to optimize or customize the blade coatings and resultant blade characteristics.

Solvents are generally selected based on their polyfluorocarbon solvency, being a liquid at a dissolution temperature, and/or having low polarity. These parameters are described in U.S. Pat. No. 5,985,459, incorporated herein by reference.

Post Treatment

After the blade edges have been solvent-treated as discussed above, the blades may be additionally treated to remove any excess solvent. This can be done by dipping the blade edge into a wash solution for the solvent. Preferably the wash solution should be easily separable from the solvent.

The following example generally illustrates the nature of the present invention which improves the quality of the first shave and subsequent shaves.

Blade Preparation Example

A batch of blades was spray coated, heated, and solvent-treated, then re-spray coated, re-heated, and re-solvent-treated as follows:

1. A fixture holding the blades was set on a carrier.

The blade fixture was preheated to greater than about 212° F. and then sprayed with a PTFE/water dispersion at about 1% (w/w). The fixture then was passed through an oven greater than about 650° F. where the PTFE coating was heated to ensure adhesion to the blade edges. The blade edges were then solvent treated at greater than about 500° F. for at least about 1 minute at a pressure at or above about 60 PSI in perfluoroperhydrophenanthrene.

2. Blade samples were collected.

A batch of blades as treated in step 1 was spray coated, heated, and solvent-treated under the same conditions described above, and additional samples were collected for assessment purposes.

Cutting Force Determination

To demonstrate the improvement in the first shave and subsequent shaves of the present invention which can impact the blade longevity, the cutting force of each blade sample is determined by measuring the force required to cut through wool felt mounted in a wool felt cutter. Each blade is generally first run through the wool felt cutter 5 times, the force of these cuts is recorded, and an initial cutting force is obtained. Each blade is then run through the wool felt cutter 500 times to simulate shaving and cutting forces are recorded. After the 500 wool felt cuts, the force of three additional cuts is measured and averaged (Avg.3).

Figure 2:
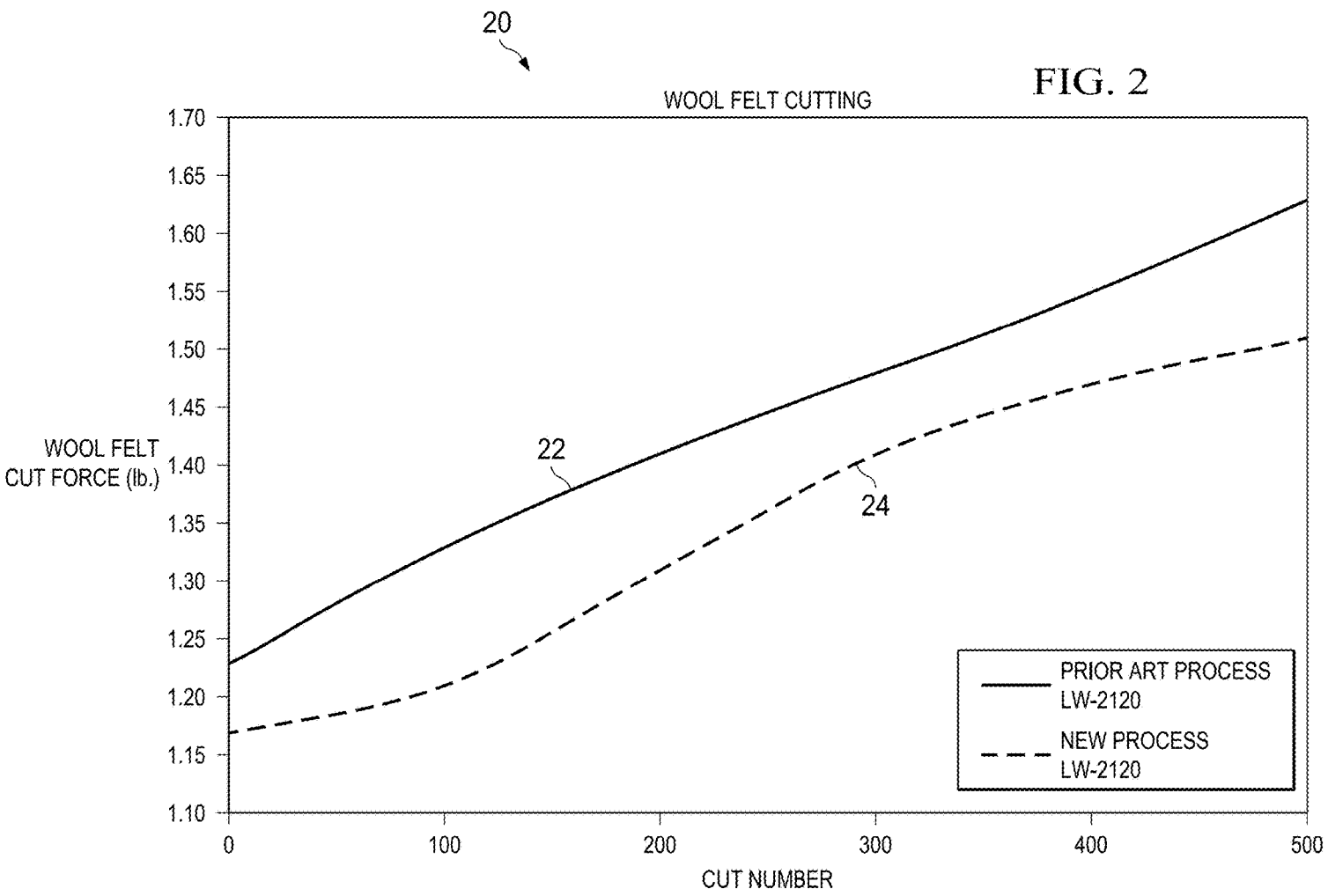
FIG. 2 is an actual plot of the force required for a razor blade to cut through wool felt vs. the number of iterations through the wool felt for blades produced with a prior art process and for blades produced according to the present invention.

A graph plot 20 of actual cut force of a present invention blade edge is found in FIG. 2. As can be seen from the plot in FIG. 2, as compared to razor blades produced by the prior art process of U.S. Pat. No. 5,985,459 shown at line 22 on graph 20, razor blade edges which have been produced according to the present invention process exhibit lower cutting forces both at first or initial cuts and through about 500 cuts, as shown at line 24, demonstrating that the lower cutting forces are achieved from the outset, and are maintained for at least 500 wool felt cuts. The type of polyfluorocarbon utilized in both of these processes was Dupont LW-2120. Three initial cuts were averaged and then, after each 100 cut increment, the average of 3 cuts was taken. In this way, an accurate representation of the cutting force data is shown.

Generally, the overall improvement or the decrease in cutting forces of the present invention versus the prior art is from about 5 to about 15 percent.

It should be noted that the magnitude of the cut forces in a plot of the type shown in FIG. 2 may vary due to variations in the wool felt itself, blade edge geometry, coatings deposited on the edge, etc., but the differential between the cut force of the conventional prior art process and the present invention process is generally anticipated to be unaffected or about the same.

Figure 3A:
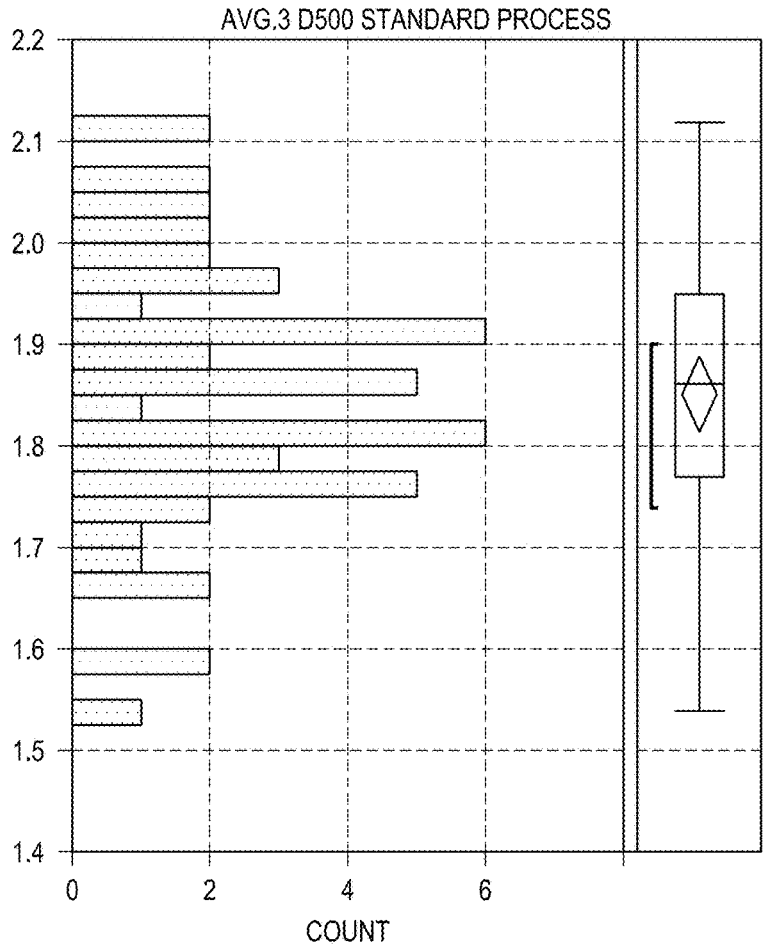
FIG. 3A (PRIOR ART)
FIG. 3A is a graph plot of a prior art process showing the wool felt cutting forces (lb) after 500 cuts in wool felt.

FIG. 3A is a graph plot shaving simulation showing the wool felt cutting forces (lb) after 500 cuts (average of 3 cuts after 500 cuts labeled Avg.3), of the prior art process of U.S. Pat. No. 5,985,459, while FIG. 3B is a graph plot shaving simulation showing the wool felt cutting forces (lb) after 500 cuts (average of 3 cuts after 500 cuts labeled Avg.3) in wool felt of the present invention process of FIG. 1.

Figure 3B:
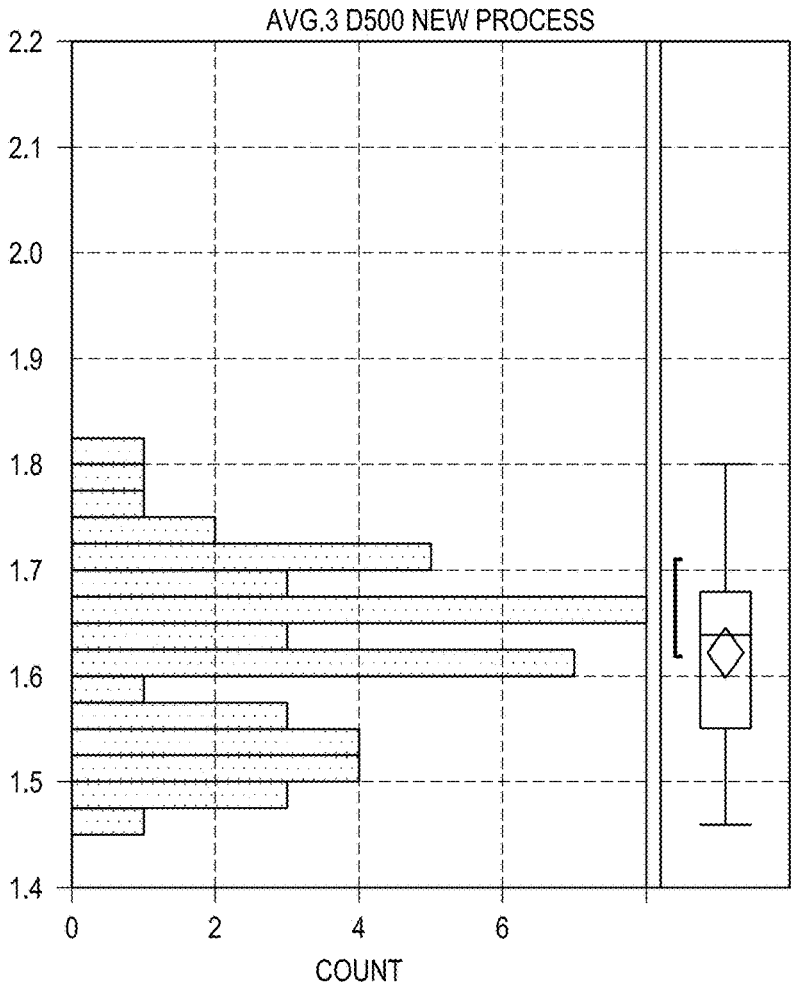
FIG. 3B is a graph plot of the process of FIG. 1 showing the wool felt cutting forces (lb) after 500 cuts in wool felt.

As can be seen by comparison, the mean cut force for FIG. 3A is about 1.85 lb with a standard deviation of about 0.13 while the mean cut force for FIG. 3B is desirably lower at about 1.62 lb with a standard deviation which is also lower at about 0.08. It is noted that an improvement is shown for all blades in FIG. 3B. More evidently the generally higher range cut forces found in the blades of the plot in FIG. 3A are desirably lowered in the blades of the plot in FIG. 3B after the performance of the process steps of FIG. 1 and in particular, process steps 16-18.

Figure 4A:
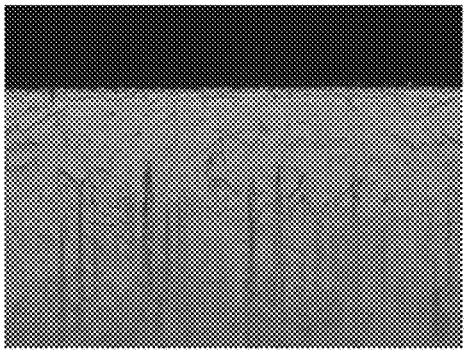
FIGS. 4A, 4B, 4C, and 4D are photomicrographs, each with magnification about 50×, of polyfluorocarbon-coated blade edges at various process steps of FIG. 1.
Figure 4B:
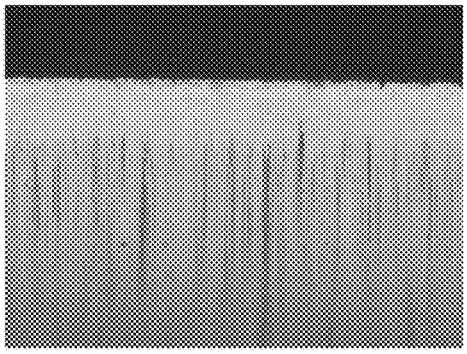

FIG. 4A depicts a photomicrograph (magnification about 50×) of the resultant polyfluorocarbon coating on a blade edge formed after the first heating step 14 of FIG. 1. FIG. 4B depicts a photomicrograph (magnification about 50×) of the resultant polyfluorocarbon coating on a blade edge formed after the first solvent treatment step 15 of FIG. 1.

Figure 4C:
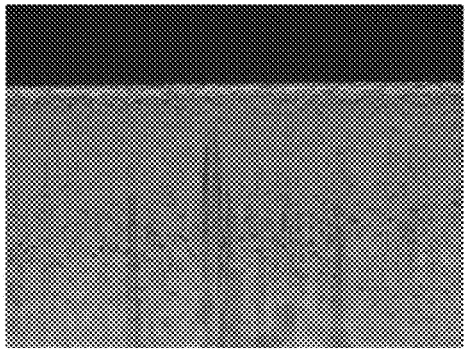
Figure 4D:
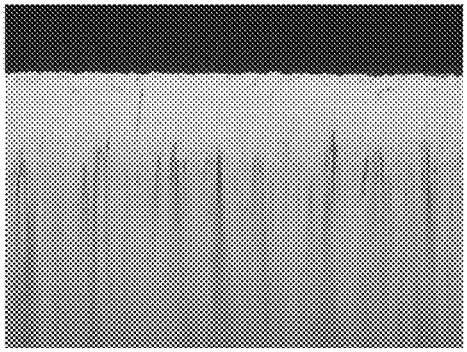

FIG. 4C depicts a photomicrograph (magnification about 50×) of the resultant polyfluorocarbon coating on a blade edge formed after a second heating step 17 of FIG. 1. FIG. 4D depicts a photomicrograph (magnification about 50×) of the resultant polyfluorocarbon coating on a blade edge formed after the second solvent treatment step 18 of FIG. 1.

Under microscopy, no visible PTFE coating is easily seen in the solvent-treated blades of FIGS. 4B and 4D as compared to FIGS. 4A and 4C, respectively, that include some PTFE crystallites.

Figure 5A:
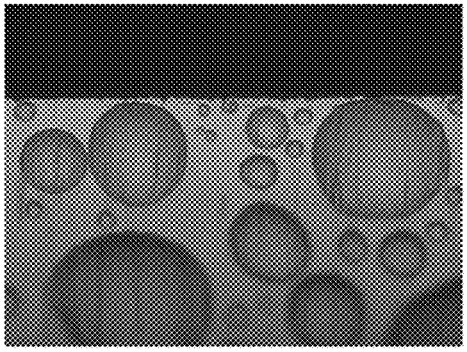
FIGS. 5A and 5B are photomicrographs, each with magnification about 50×, of polyfluorocarbon-coated blade edges of FIGS. 4B and 4D showing beads of silicone oil liquid.
Figure 5B:
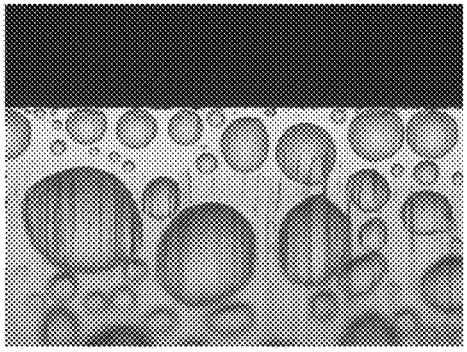

FIGS. 5A and 5B correspond to FIGS. 4B and 4D (photomicrographs after steps 15 and 18 of FIG. 1) respectively, each with beads of liquid depicting silicone oil sprayed on the blade edges. The generally uniform circular beading of oil on the blade edges demonstrates that the coated metal surface, after both first and second solvent treatments, retains an adequate PTFE coating. It should be noted that silicone oil spreads but does not bead on uncoated blade edges. The cutting forces of the blades in FIGS. 4B and 4D are low, reinforcing that each solvent treatment effectively removes non-adherent PTFE coating resulting in a thin polyfluorocarbon layer.

Unpredictably, as noted above, despite the lack of an obvious difference in the coating after the first solvent step of FIG. 4B as compared to the coating after the second solvent step of FIG. 4D, the cutting forces of the blades in FIG. 4D produced in accordance with the present invention are generally significantly lower than those of FIG. 4B.

The present invention process may be expanded beyond the coatings desired in the razor arts, to other devices or products that utilize or could utilize a polyfluorocarbon coating. For instance, low friction and wear resistant coatings are desirable in tools such as cutting implements including knives, scalpels, saws, etc., as well as in mechanical parts such as bearing surfaces, gears, etc. Other areas of potential application include non-stick and release coatings as well as water resistant coatings.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of forming a polyt1uorocarbon coating on a razor blade cutting edge comprising the steps of:

(a) coating a razor blade cutting edge with a first dispersion of polyfluorncarbon in a dispersing medium;

(b) heating the coating to adhere the polyfluorocarbon to said razor blade cutting edge;

(c) treating said razor blade cutting edge with a first solvent to partially remove said first coating;

(d) coating said razor blade cutting edge with a second dispersion of polyfluorocarbon in a dispersing medium, wherein said second dispersion is disposed over said first coating; and (e) heating the coating of step (d) to adhere the second polyfluorocarbon to said razor blade cutting edge.

2. The method of forming a polyfluorocarbon coating on a razor blade cutting edge according to claim 1 further comprising the step of:

(f) treating the razor blade cutting edge of step (e) with a second solvent to partially remove said second coating of step (d).

3. The method of forming a polyfluorocarbon coating on a razor blade cutting edge according to claim 2 wherein the critical temperature or boiling point of said first and second solvents is above the dissolution temperature for said first and second polyfluorocarbons in said first and second solvents, respectively, and wherein the blade treatment step (c)

or step (f) occurs at a process temperature below the boiling point or critical temperature of the first and second solvents, respectively, and above the dissolution temperature for said first and second polyfluorocarbons, respectively, in said first and second solvents.

4. The method of forming a polyfluorocarbon coating on a razor blade cutting edge according to claim 3 wherein said first and said second solvent are selected from the group consisting of perfluoroalkanes, perfluorocycloalkanes, perfluoroaromatic compounds and oligomers thereof.

5. The method of forming a polyfluorocarbon coating on a razor blade cutting edge according to claim 1 wherein said polyfluorocarbon is polytetrafluoroethylene having an average molecular weight of from 700 to 4,000,000 grams/mole.

6. The method of forming a polyfluorocarbon coating on a razor blade cutting edge according to claim 5 wherein said polytetrafluoroethylene has an average molecular weight of from 22,000 to 200,000 grams/mole.

7. The method of forming a polyfluorocarbon coating on a razor blade cutting edge according to claim 1 wherein said polyfluorocarbon of step (a) is polytetrafluoroethylene having an average molecular weight and molecular weight distribution, and wherein said polyfluorocarbon of step (d) is polytetrafluoroethylene having a different average molecular weight and/or molecular weight distribution than the polyfluorocarbon of step (a).

8. The method of forming a polyfluorocarbon coating on a razor blade cutting edge according to claim 7 wherein said polytetrafluoroethylene of step (a) comprises an average molecular weight of from greater than 200,000 to 4,000,000 grams/mole and said polytetrafluoroethylene of step (d) comprises an average molecular weight of from 3,000 to 200,000 grams/mole.

9. The method of forming a polyfluorocarbon coating on a razor blade cutting edge according to claim 7 wherein said polytetrafluoroethylene of step (a) comprises an average molecular weight of from 3,000 to 200,000 grams/mole and said polytetrafluoroethylene of step (d) comprises an average molecular weight of from greater than 200,000 to 4,000,000 grams/mole.

10. The method of forming a polyfluorocarbon coating on a razor blade cutting edge according to claim 1 wherein said polyfluorocarbon of step (a) is polytetrafluoroethylene having an average molecular weight and molecular weight distribution, and wherein said polyfluorocarbon of step (d) is polytetrafluoroethylene having substantially the same average molecular weight and molecular weight distribution as the polyfluorocarbon of step (a).

11. The method of forming a polyfluorocarbon coating on a razor blade cutting edge according to claim 1 wherein said polyfluorocarbon of step (a) is polytetrafluoroethylene having an average molecular weight of from greater than 200,000 to 4,000,000 grams/mole and wherein said polyfluorocarbon of step (d) is polytetrafluoroethylene having an average molecular weight of from greater than 200,000 to 4,000,000 grams/mole.

12. The method of forming a polyfluorocarbon coating on a razor blade cutting edge according to claim 1 wherein said polyfluorocarbon of step (a) is polytetrafluoroethylene having an average molecular weight of from 3,000 to 200,000 grams/mole and wherein said polyfluorocarbon of step (d) is polytetrafluoroethylene having an average molecular weight of from 3,000 to 200,000 grams/mole.

13. The method of forming a polyfluorocarbon coating on a razor blade cutting edge according to claim 2 wherein said first solvent of step (c) and said second solvent of step (f) differ in composition, temperature, and/or method of application.

14. The method of forming a polyfluorocarbon coating on a razor blade cutting edge according to claim 2 wherein said first and/or second solvent is selected from the group consisting of:

dodecafluorocyclohexane ($C_6F_{12}$),
octafluoronaphthalene ($C_{10}F_8$),
perfluorotetracosane (n-$C_{24}F_{50}$),
perfluoroperhydrophenanthrene ($C_{14}F_{24}$),
isomers of perfluoroperhydrobenzylnaphthalene ($C_{17}F_{30}$),
high-boiling oligomeric byproducts in the manufacture of perfluoroperhydrophenanthrene ($C_{14}F_{24}$),
perfluoropolyethers, or any combinations thereof.

15. The method of forming a polyfluorocarbon coating on a razor blade cutting edge according to claim 14 wherein said first and/or second solvent comprises perfluoroperhydrophenanthrene.

16. The method of forming a polyfluorocarbon coating on a razor blade cutting edge according to claim 2 further comprising a post treatment step (g) to remove excess solvent.

17. The method of forming a polyfluorocarbon coating on a razor blade cutting edge according to claim 2 wherein the cutting force obtained after step (f) is reduced by 5 to 15 percent over the cutting force obtained after step (c) for initial cuts and over the life of the blade.

18. The method of forming a polyfluorocarbon coating on a razor blade cutting edge according to claim 1 wherein the cutting force obtained after step (e) is reduced by 5 to 15 percent over the cutting force obtained after step (c) over the life of the blade.

19. The method of forming a polyfluorocarbon coating on a razor blade cutting edge according to claim 1 wherein after said heating step (b) and/or step (e) a thickness of the polyfluorocarbon coating is greater than about 1.0 micrometers.

20. The method of forming a polyfluorocarbon coating on a razor blade cutting edge according to claim 2 wherein steps (d), (e) and (f) are performed more than one time.

21. A razor blade cutting edge produced according to the method of claim 1.

* * * * *